US011831107B2

(12) United States Patent
Maesoba et al.

(10) Patent No.: US 11,831,107 B2
(45) Date of Patent: Nov. 28, 2023

(54) CONNECTOR HAVING MODULE ACCOMMODATING PORTION FOR PRESSING FIXING BARREL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 235 days.

(21) Appl. No.: 17/418,500

(22) PCT Filed: Dec. 24, 2019

(86) PCT No.: PCT/JP2019/050526
§ 371 (c)(1),
(2) Date: Jun. 25, 2021

(87) PCT Pub. No.: WO2020/138038
PCT Pub. Date: Jul. 2, 2020

(65) Prior Publication Data

US 2022/0077637 A1 Mar. 10, 2022

(30) Foreign Application Priority Data

Dec. 28, 2018 (JP) ..... 2018-247609

(51) Int. Cl.
*H01R 13/6593* (2011.01)
*H01R 4/18* (2006.01)
(Continued)

(52) U.S. Cl.
CPC ..... *H01R 13/6593* (2013.01); *H01R 4/18* (2013.01); *H01R 4/183* (2013.01); *H01R 9/0518* (2013.01);
(Continued)

(58) Field of Classification Search
CPC ..... H01R 13/6593; H01R 4/18; H01R 4/183; H01R 9/0518; H01R 13/42; H01R 13/629;
(Continued)

(56) References Cited

U.S. PATENT DOCUMENTS 5,667,404 A 9/1997 Kato et al.
8,926,368 B2 1/2015 Il
(Continued)

FOREIGN PATENT DOCUMENTS

JP H05-031164 U 4/1993
JP 2000-012165 A 1/2000
(Continued)

OTHER PUBLICATIONS

International Search Report dated Feb. 18, 2020 for WO 2020/138038 A1 (5 pages).

*Primary Examiner* — Abdullah A Riyami
*Assistant Examiner* — Justin M Kratt
(74) *Attorney, Agent, or Firm* — Venjuris, P.C.

(57) ABSTRACT

A connector disclosed by this specification is provided with a shielded cable including a conductive shield portion for covering outer peripheries of two coated wires and a sheath portion for covering an outer periphery of the shield portion, a first outer conductor including a tubular portion and to be
(Continued)

connected to the shield portion, a second outer conductor including two plate-like fixing barrels to be crimped to wind around an outer surface of the tubular portion in a circumferential direction, and a housing including a module accommodating portion for accommodating an outer conductor formed by the first and second outer conductors by the fixing barrels being crimped to the tubular portion. The module accommodating portion includes a central ceiling wall capable of pressing the fixing barrels toward proper crimping positions in the process of accommodating the outer conductor.

6 Claims, 17 Drawing Sheets

(51) Int. Cl.

| | |
|---|---|
| ***H01R 13/42*** | (2006.01) |
| ***H01R 13/629*** | (2006.01) |
| ***H01R 13/6581*** | (2011.01) |
| ***H01R 13/6592*** | (2011.01) |
| ***H01R 9/05*** | (2006.01) |
| ***H01R 43/048*** | (2006.01) |
| *H01R 13/6591* | (2011.01) |
| *H01R 13/40* | (2006.01) |
| *H01R 13/422* | (2006.01) |

(52) U.S. Cl.
CPC ..... *H01R 13/42* (2013.01); *H01R 13/629* (2013.01); *H01R 13/6581* (2013.01); *H01R 13/6592* (2013.01); *H01R 43/048* (2013.01); *H01R 9/05* (2013.01); *H01R 13/40* (2013.01); *H01R 13/422* (2013.01); *H01R 13/4223* (2013.01); *H01R 13/6591* (2013.01)

(58) Field of Classification Search
CPC ..... H01R 13/6581; H01R 13/6592; H01R 43/048; H01R 9/05; H01R 13/40; H01R 13/422; H01R 13/4223; H01R 13/6591
See application file for complete search history.

(56) References Cited

U.S. PATENT DOCUMENTS

| | | | | |
|---|---|---|---|---|
| 10,910,733 | B2 | 2/2021 | Miyamoto et al. | |
| 2013/0288522 | A1 * | 10/2013 | Ii ..... | H01R 13/4223 439/607.01 |

FOREIGN PATENT DOCUMENTS

| | | | | |
|---|---|---|---|---|
| JP | 2011-233425 | A | 11/2011 | |
| WO | WO-2017163803 | A1 * | 9/2017 | ..... H01R 13/648 |

* cited by examiner

CONNECTOR HAVING MODULE ACCOMMODATING PORTION FOR PRESSING FIXING BARREL

CROSS REFERENCE TO RELATED APPLICATIONS

This application is a national phase of PCT application No. PCT/JP2019/050526, filed on 24 Dec. 2019, which claims priority from Japanese patent application No. 2018-247609, filed on 28 Dec. 2018, all of which are incorporated herein by reference.

TECHNICAL FIELD

A technique disclosed by this specification relates to a connector.

BACKGROUND

A shield connector connected to an end of a shielded cable for transmitting a communication signal is, for example, known from Japanese Patent Laid-open Publication No. 2013-229255 (Patent Document 1 below). This shield connector includes a male terminal to be connected to a shield wire exposed by stripping a shield foil and a sheath portion of the shielded cable, an inner housing for accommodating the male terminal, a shield shell including a tubular portion for covering the inner housing and to be connected to the shield foil of the shielded cable, a shield shell cover for covering the shield shell and an outer housing for accommodating the shield shell covering the inner housing.

The shield shell is accommodated into the outer housing after the shield shell cover is fixed to the shield shell by locking claws provided on side plate portions of the shield shell into locking holes formed in side parts of the shield shell cover.

PRIOR ART DOCUMENT

Patent Document

Patent Document 1: JP 2013-229255 A

SUMMARY OF THE INVENTION

Problems to be Solved

By crimping an extending piece formed to extend from a second conductor to wind around the outer peripheral surface of a first conductor as means for fixing the second conductor made of metal and equivalent to the shield shell cover to the first conductor made of metal and equivalent to the shield shell, the second conductor can be fixed to the first conductor without complicating the structures of the conductors, such as by forming the locking claws on the first conductor and forming the locking holes in the second conductor.

However, if the extending piece of the second conductor is crimped to wind around the outer peripheral surface of the first conductor, there is a concern that the extending piece is lifted from the outer surface of the first conductor due to so-called springback of the extending piece deformed by crimping to slightly return to an initial state.

A technique for suppressing the occurrence of springback in a conductor is disclosed in this specification.

Means to Solve the Problem

The technique disclosed by this specification is directed to a connector with a shielded cable including a conductive shield portion for covering an outer periphery of at least one coated wire and a sheath portion for covering an outer periphery of the shield portion, a first outer conductor including a tubular connecting portion and to be connected to the shield portion, a second outer conductor including at least one plate-like fixing barrel to be crimped to wind around an outer surface of the connecting portion in a circumferential direction, and a housing including a terminal accommodating portion for accommodating an outer conductor formed by the first and second outer conductors by the fixing barrel being crimped to the connecting portion, the terminal accommodating portion including a pressing portion capable of pressing the fixing barrel toward a proper crimping position in the process of accommodating the outer conductor.

According to the connector thus configured, if the fixing barrel is arranged at an improper crimping position lifted from the outer surface of the connecting portion and different from the proper crimping position, the fixing barrel can be arranged at the proper crimping position by being pressed by the pressing portion in accommodating the outer conductor into the terminal accommodating portion. In this way, a springback state of the fixing barrel of the outer conductor can be prevented and the occurrence of troubles such as a reduction in communication quality in the connector can be prevented.

The connector disclosed by this specification may be configured as follows.

The terminal accommodating portion may include a bottom wall, a bottom part located opposite to the fixing barrel in the outer conductor being arranged on the bottom wall, and a distance between the bottom wall and the pressing portion may be substantially equal to a height of a part crimped with the fixing barrel in the outer conductor. Here, substantially equal means a case where the distance between the bottom wall and the pressing portion and the height of the part crimped with the fixing barrel are equal and cases where the distance between the bottom wall and the pressing portion and the height of the part crimped with the fixing barrel can be regarded as substantially equal even if these are different.

According to this configuration, in accommodating the outer conductor into the terminal accommodating portion, the fixing barrel is pressed by the pressing portion so that the outer conductor is sandwiched by the bottom wall and the pressing portion. In this way, the fixing barrel can be arranged at the proper crimping position.

The second outer conductor may further include at least one connection barrel to be crimped to the shielded portion together with the first outer conductor, the terminal accommodating portion may include a first accommodating portion for accommodating the fixing barrel and a second accommodating portion for accommodating the connection barrel, and the pressing portion may be formed from an end part of the first accommodating portion on the second accommodating portion side toward an end part of the first accommodating portion opposite to the second accommodating portion.

For example, if a pressing portion capable of pressing a fixing barrel is provided on an end part of a module accommodating portion, there is a concern that the pressing portion is damaged due to the contact of the pressing portion with another member during the conveyance of a housing and the fixing barrel cannot be arranged at a proper crimping position or an outer conductor cannot be accommodated into a terminal accommodating portion due to the collision of the damaged pressing portion and the outer conductor.

However, according to this configuration, since the pressing portion is formed from the end part of the first accommodating portion on the second accommodating portion side toward the end part of the first accommodating portion opposite to the second accommodating portion, the contact of another member with the pressing portion can be prevented.

An end part of the pressing portion on the second accommodating portion side may be expanded in diameter to be rounded from the first accommodating portion side toward the second accommodating portion side.

According to this configuration, since the end part of the pressing portion is expanded in diameter to be rounded from the first accommodating portion side toward the second accommodating portion side, the fixing barrel can be guided into the first accommodating portion by the pressing portion and the outer conductor can be accommodated into the terminal accommodating portion. In this way, an operation of accommodating the outer conductor can be smoothly performed.

The pressing portion may be a ceiling wall facing the bottom wall in the first accommodating portion.

According to this configuration, since the fixing barrel is pressed by the ceiling wall of the terminal accommodating portion, it is not necessary to separately form a pressing portion for pressing the fixing barrel in the terminal accommodating portion. Thus, the complication of the structure of the terminal accommodating portion can be prevented.

The connecting portion may be formed with a protrusion projecting outward, the second outer conductor may include a pair of the fixing barrels, and the pair of fixing barrels may be crimped to both sides of the protrusion in an extending direction of the shielded cable.

According to this configuration, since the pair of fixing barrels are reliably arranged at the proper crimping positions by the pressing portion, the detachment of the outer conductor from the shielded cable can be reliably prevented by the locking of the fixing barrel and the protrusion in the extending direction of the shielded cable, for example, when the shielded cable is pulled.

An inclined surface inclined toward the connecting portion side along an accommodation direction of the outer conductor may be formed on an end edge part of the fixing barrel on a side to be accommodated into the terminal accommodating portion.

According to this configuration, since the inclined surface is formed on the end edge part of the fixing barrel, it can be suppressed that the pressing portion is damaged, such as by being scraped by the fixing barrel, as compared to the case where an edge is provided the end edge part of the fixing barrel.

Effect of the Invention

According to the technique disclosed by this specification, it is possible to suppress the occurrence of springback in a conductor.

DETAILED DESCRIPTION TO EXECUTE THE INVENTION

Embodiment

Figure 1:
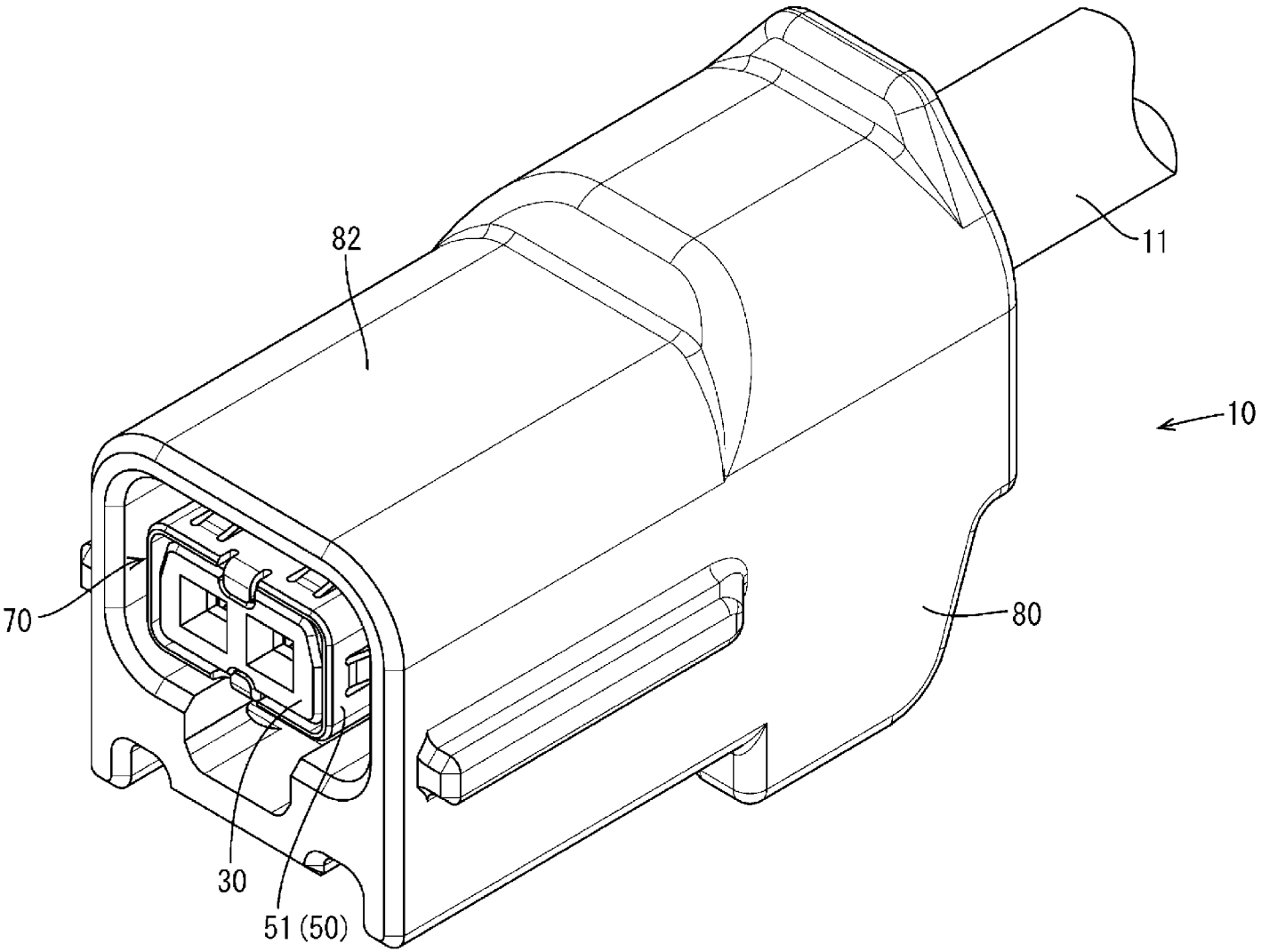
FIG. 1 is a perspective view of a connector according to an embodiment.
Figure 2:
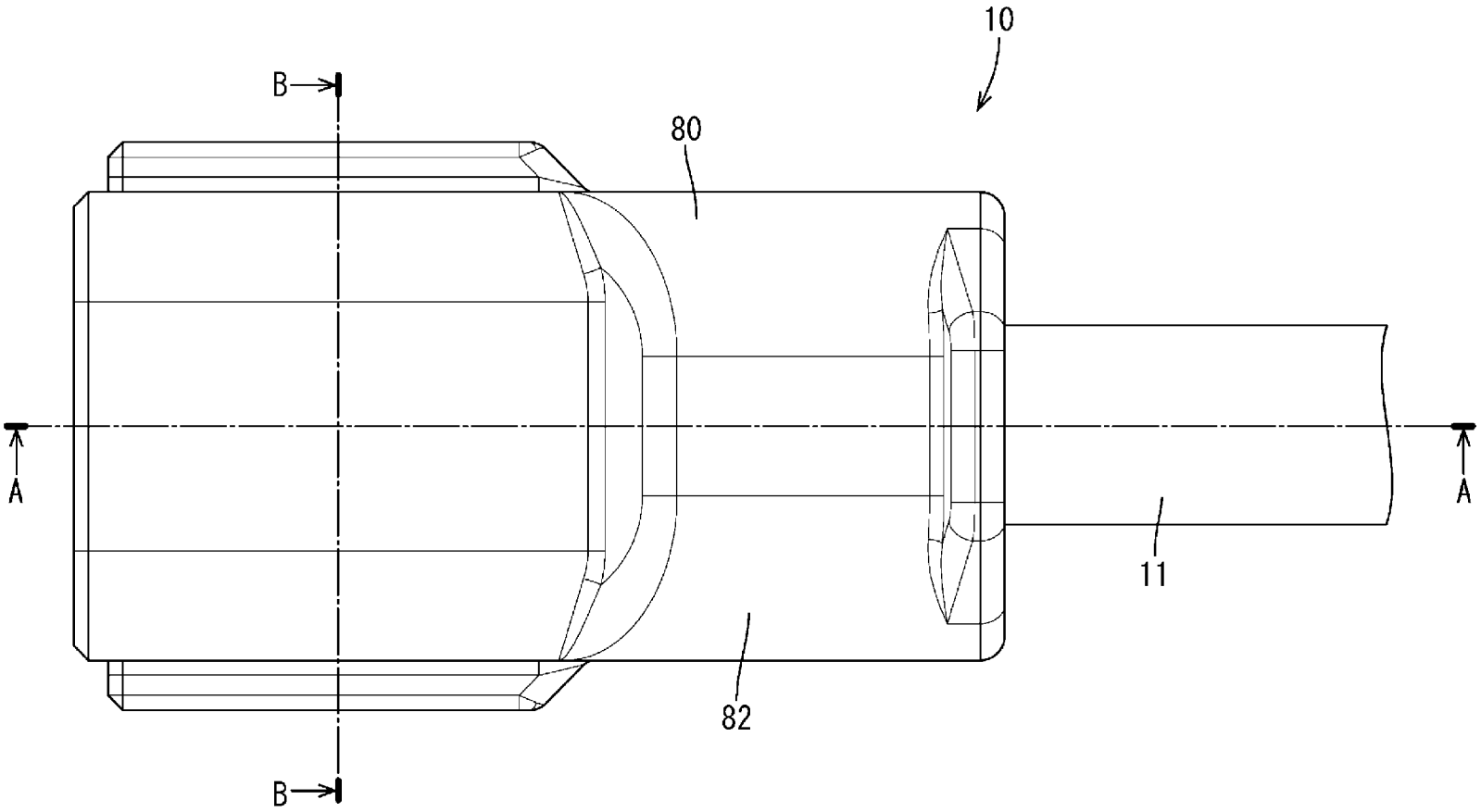
FIG. 2 is a plan view of the connector.

One embodiment of the technique disclosed in this specification is described with reference to FIGS. 1 to 17.

A connector 10 for communication to be installed, for example, in a vehicle such an electric vehicle or hybrid vehicle and disposed in a wired communication path, for example, between an in-vehicle electrical component (car navigation system, ETC, monitor or the like) in the vehicle and an external device (camera or the like) or between in-vehicle electrical components is illustrated in this embodiment.

The connector 10 is connectable to an unillustrated mating connector and includes, as shown in FIGS. 1 to 5, a housing 80 and a terminal module (example of a "terminal accommodating portion") 70 to be accommodated into the housing 80.

The terminal module 70 includes a shielded cable 11, a plurality of inner conductors 20 to be connected to a front end of the shielded cable 11, an inner conductor accommodating member 30 for accommodating the plurality of inner conductors 20, an outer conductor 50 to be connected to the shielded cable 11 while covering the outer periphery of the inner conductor accommodating member 30, and the housing 80 for accommodating the outer conductor 50.

The shielded cable 11 includes two coated wires 12 having the inner conductors 20 connected thereto, a shield portion 15 constituted by a braided wire for collectively covering the outer peripheries of the coated wires 12, and a sheath portion 16 constituted by an insulating coating for covering the outer periphery of the shield portion 15.

In a front end part of the shielded cable 11, the shield portion 15 exposed from an end of the sheath portion 16 by stripping the sheath portion 16 is folded on an end part of the sheath portion 16 to form a folded portion 15A.

The inner conductor accommodating member 30 is made of synthetic resin and in the form of a rectangular parallelepiped long in a front-back direction.

Figure 10:
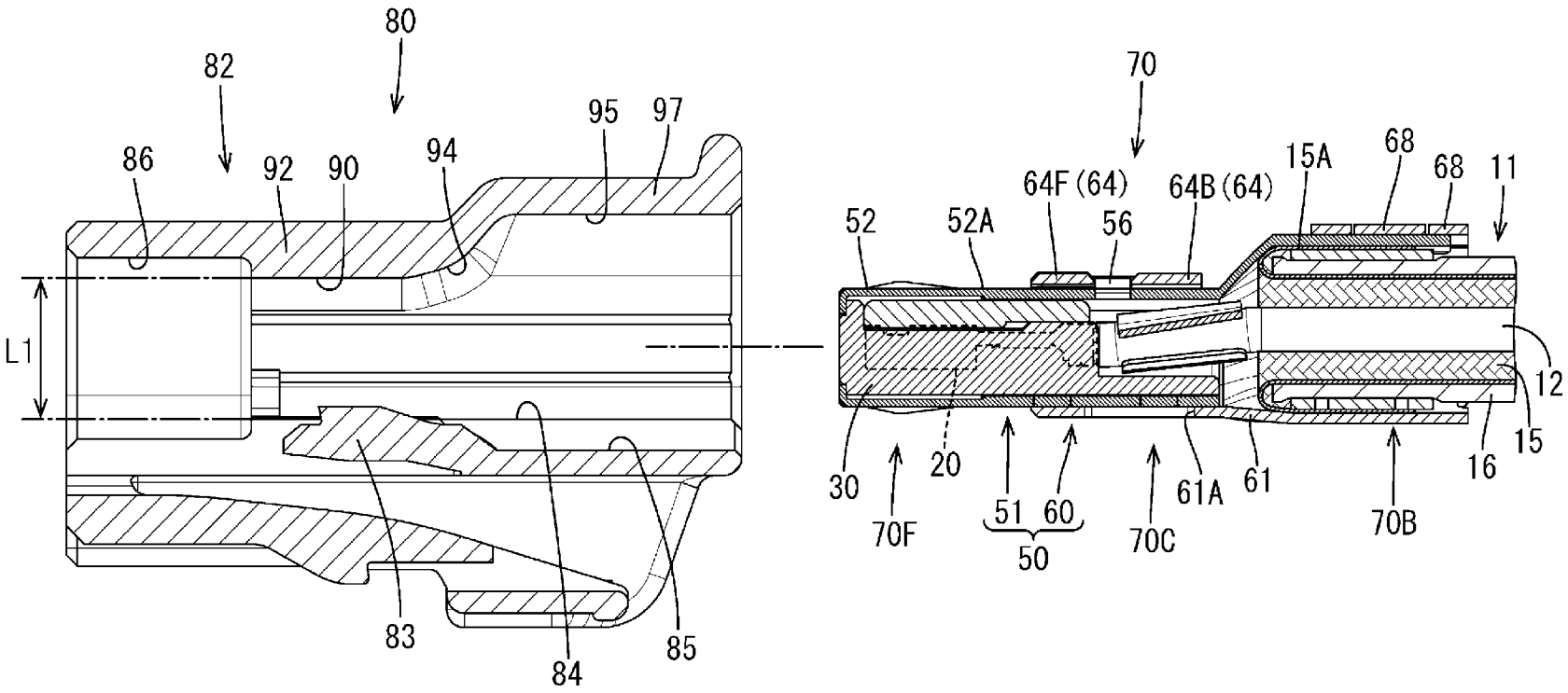
FIG. 10 is a section along C-C of FIG. 9.
Figure 11:
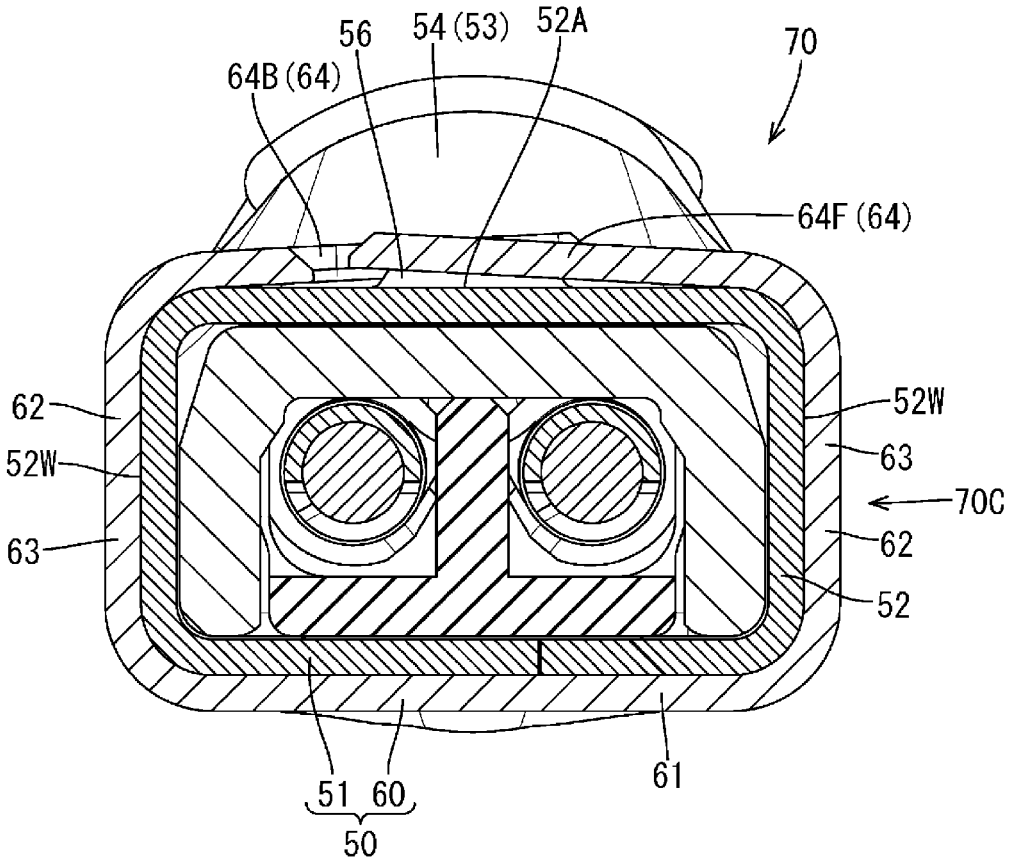
FIG. 11 is a section along D-D of FIG. 9.

As shown in FIGS. 10 and 11, two inner conductors 20 connected to the coated wires 12 are accommodated side by side in a lateral direction in the inner conductor accommodating member 30.

Figure 3:
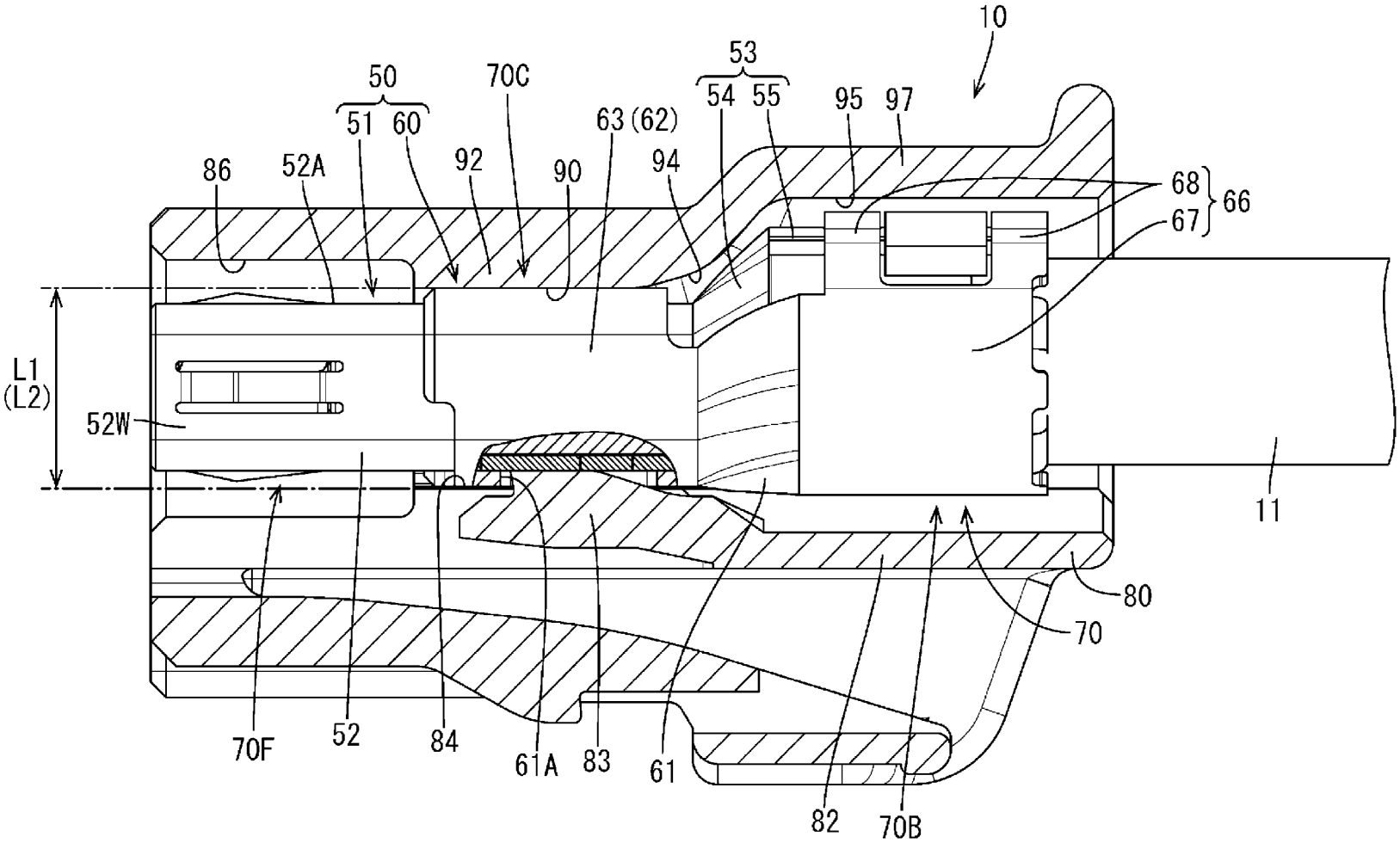
FIG. 3 is a section along A-A of FIG. 2.

The outer conductor 50 is fittable and connectable to an unillustrated mating outer conductor provided in the mating connector and, as shown in FIGS. 3 and 10, is composed of a first outer conductor 51 for covering the outer periphery of the inner conductor accommodating member 30 and a second outer conductor 60 to be assembled with the first outer conductor 51 to cover the outer peripheries of the first outer conductor 51 and the folded portion 15A of the shielded cable 11.

Figure 6:
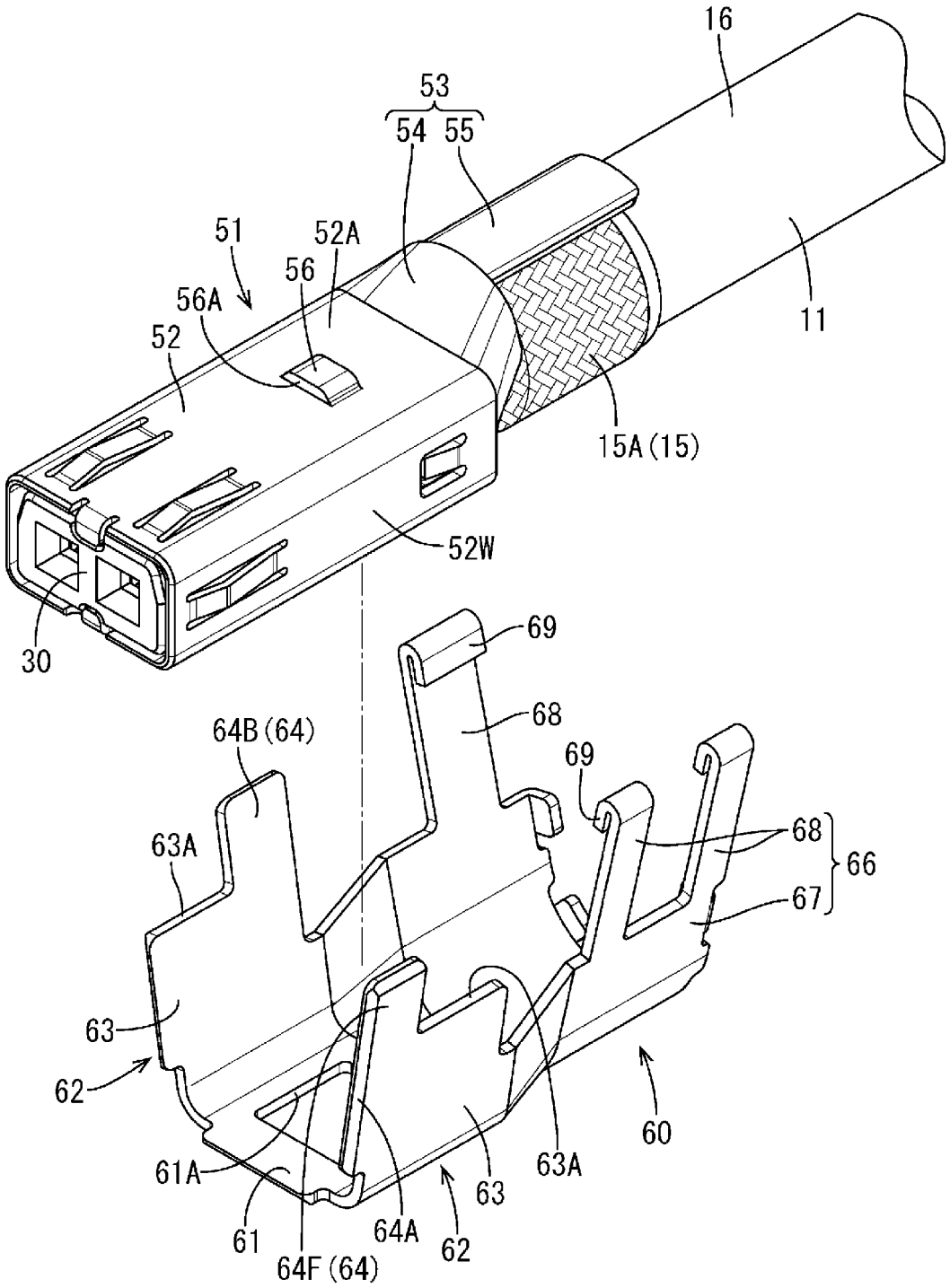
FIG. 6 is a perspective view showing a state before a first outer conductor and a second outer conductor are assembled.

The first outer conductor 51 is formed by working a conductive metal plate material by a press or the like. As shown in FIG. 6, the first outer conductor 51 includes a tubular portion (example of a "connecting portion") 52 for accommodating the inner conductor accommodating member 30 and a shield connecting portion 53 provided on the back end edge of an upper side of the tubular portion 52.

As shown in FIG. 6, the tubular portion 52 is in the form of a rectangular tube having a substantially rectangular front view shape, and the unillustrated mating outer conductor is fittable outside the tubular portion 52. A positioning protrusion 56 projecting upward is formed on an upper surface 52A of the tubular portion 52.

The positioning protrusion 56 has a substantially rectangular shape in a plan view, and the front and back surfaces of the positioning protrusion 56 serve as positioning surfaces 56A facing forward and backward along an extending direction of the shielded cable 11.

The shield connecting portion 53 includes a linking piece 54 obliquely extending to an upper-back side from the back end edge of the upper side of the tubular portion 52 and a tongue piece 55 in the form of a substantially rectangular plate extending backward from the back end edge of the linking piece 54.

The tongue piece 55 is formed to be continuous with the back end edge of the linking piece 54. When the inner conductor accommodating member 30 is accommodated into the tubular portion 52, the tongue piece 55 is arranged above the folded portion 15A in the shielded cable 11 as shown in FIG. 6.

Figure 5:
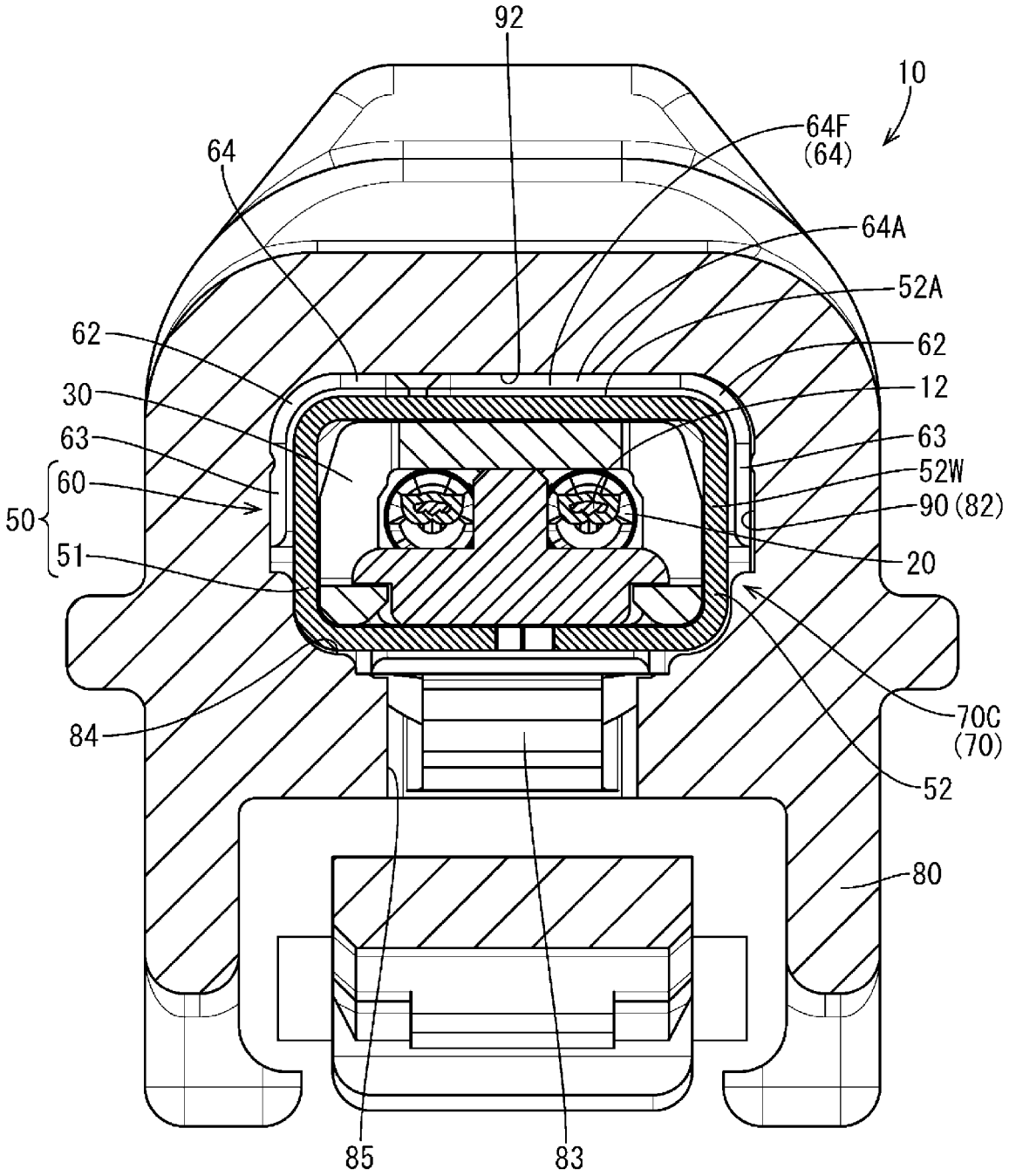
FIG. 5 is a section along B-B of FIG. 2.

The second outer conductor 60 is formed by working a conductive metal plate material by a press or the like. As shown in FIGS. 3 and 5, the second outer conductor 60 includes a covering portion 61 extending from the tubular portion 52 to the position of the folded portion 15A of the shielded cable 11, a pair of fixing barrels (example of a "barrel") 62 provided on the front edge of the covering portion 61 and a pair of connection barrels 66 provided on the back edge of the covering portion 61.

The covering portion 61 is dimensioned to cover a region from a back part of the tubular portion 52 to the folded portion 15A from below, and a lance hole 61A penetrating in the vertical direction is provided in a front part of the covering portion 61.

Figure 7:
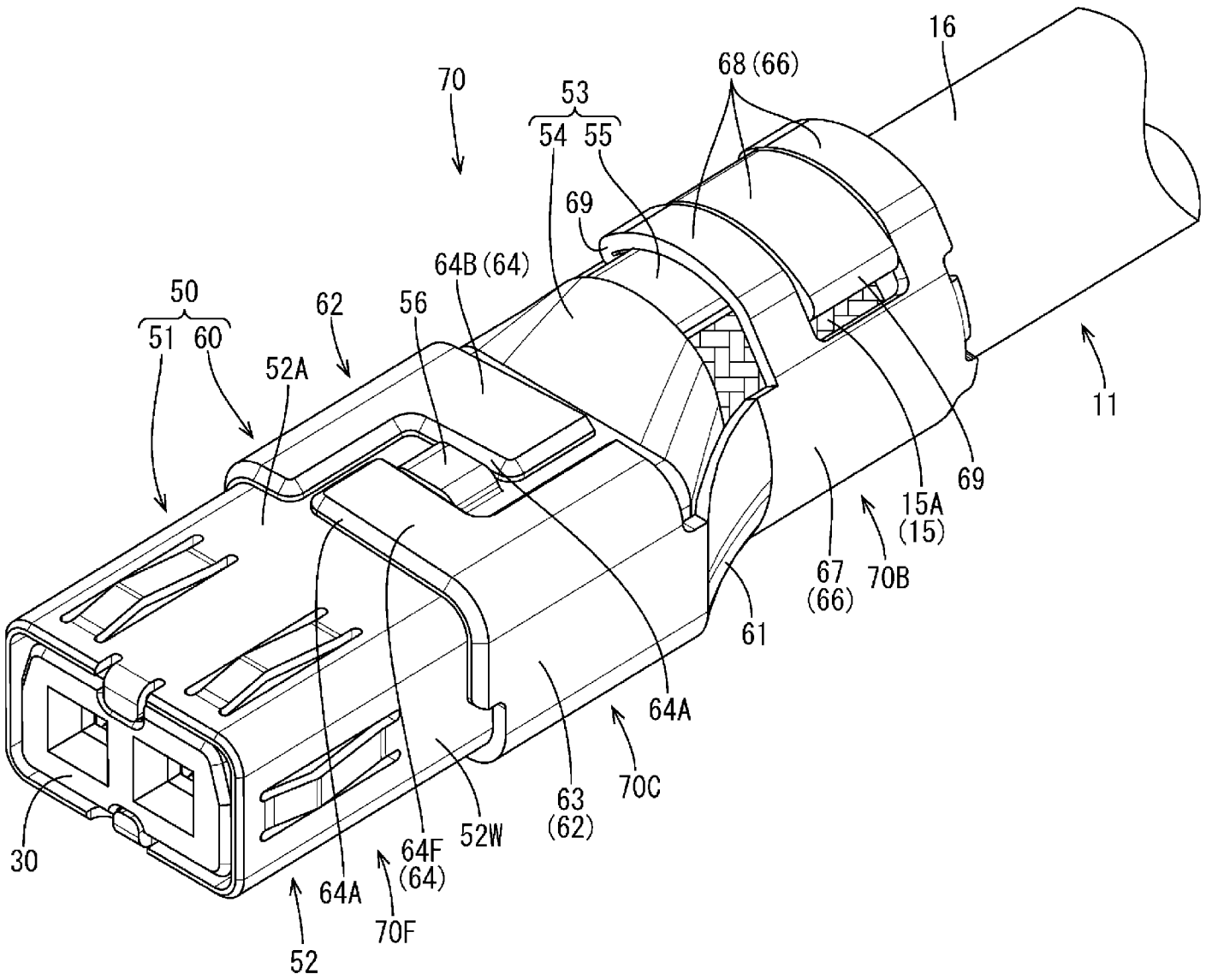
FIG. 7 is a perspective view of a terminal module.

As shown in FIG. 7, the pair of fixing barrels 62 are respectively provided on side edges on both lateral sides in a front part of the covering portion 61, and each fixing barrel 62 includes a front side plate 63 to be arranged along a side surface 52W of the tubular portion 52 and a positioning piece 64 provided on an upper edge 63A of the front side plate 63.

The positioning piece 64 of one of the pair of fixing barrels 62 serves as a front positioning piece 64F formed in a front part of the front side plate 63, and the positioning piece 64 of the other fixing barrel 62 serves as a back positioning piece 64B formed in a back part of the front side plate 63.

The pair of fixing barrels 62 extend straight from the side edges on the both lateral sides of the covering portion 61 toward oblique upper sides to be separated from each other as shown in FIG. 6 in a state before the second outer conductor 60 is assembled with the first outer conductor 51. When the second outer conductor 60 is assembled with the first outer conductor 51, the pair of fixing barrels 62 are crimped to wind around an outer surface of the back part of the tubular portion 52 in a circumferential direction from both lateral sides as shown in FIG. 7.

Further, when the pair of fixing barrels 62 are crimped to the tubular portion 52, the front side plates 63 thereof are arranged along the side surfaces 52W of the tubular portion 52, the front positioning piece 64F is arranged in front of the positioning protrusion 56 on the upper surface 52A of the tubular portion 52 and the back positioning piece 64B is arranged behind the positioning protrusion 56 on the upper surface 52A of the tubular portion 52 as shown in FIG. 7.

Accordingly, for example, if the shielded cable 11 is pulled, the detachment of the outer conductor 50 from the shielded cable 11 can be prevented by the locking of the positioning piece 64 and the positioning protrusion 56 in the front-back direction, which is the extending direction of the shielded cable 11.

The pair of connection barrels 66 are provided on side edges on both lateral sides in a back part of the covering portion 61 to be connected behind the pair of fixing barrels 62. One of the pair of connection barrels 66 includes a back side plate 67 to be arranged along one lateral side part of the folded portion 15A and one fixing piece 68 provided on the upper end of the back side plate 67, and the other connection barrel 66 includes a back side plate 67 to be arranged along the other lateral side part of the folded portion 15A and two fixing pieces 68 provided on the upper end of the back side plate 64.

Further, the pair of connection barrels 66 extend straight from the side edges on the both lateral sides of the covering portion 61 toward oblique upper sides to be separated from each other as shown in FIG. 6 in the state before the second outer conductor 60 is assembled with the first outer conductor 51. When the second outer conductor 60 is assembled with the first outer conductor 51, the pair of connection barrels 66 are crimped and fixed to wind around a lower part of the folded portion 15A together with the tongue piece 55 of the first outer conductor 51 arranged above the folded portion 15A as shown in FIG. 7.

Further, a hook portion 69 folded inwardly is formed on a tip part of each fixing piece 68.

As shown in FIG. 7, the hook portion 69 is hooked to either one of both lateral side edges of the tongue piece 55 when each fixing piece 68 is crimped, thereby fixing the fixing piece 68 so as not to be detached from the shield portion 15. In this way, the outer conductor 50 composed of the first and second outer conductors 51, 60 is electrically connected and fixed to the shield portion 15 of the shielded cable 11.

That is, an outer side of the terminal module 70 is constituted by a module front part 70F formed by the front part of the tubular portion 52, a module central part 70C in which the pair of fixing barrels 62 are crimped to the tubular portion 52 and a module back part 70B in which the pair of connection barrels 66 are crimped to the folded portion 15A of the shielded cable 11.

The housing 80 is made of synthetic resin and includes, as shown in FIGS. 3 and 10, a module accommodating portion (example of a "terminal accommodating portion") 82 for accommodating the terminal module 70.

Figure 8:
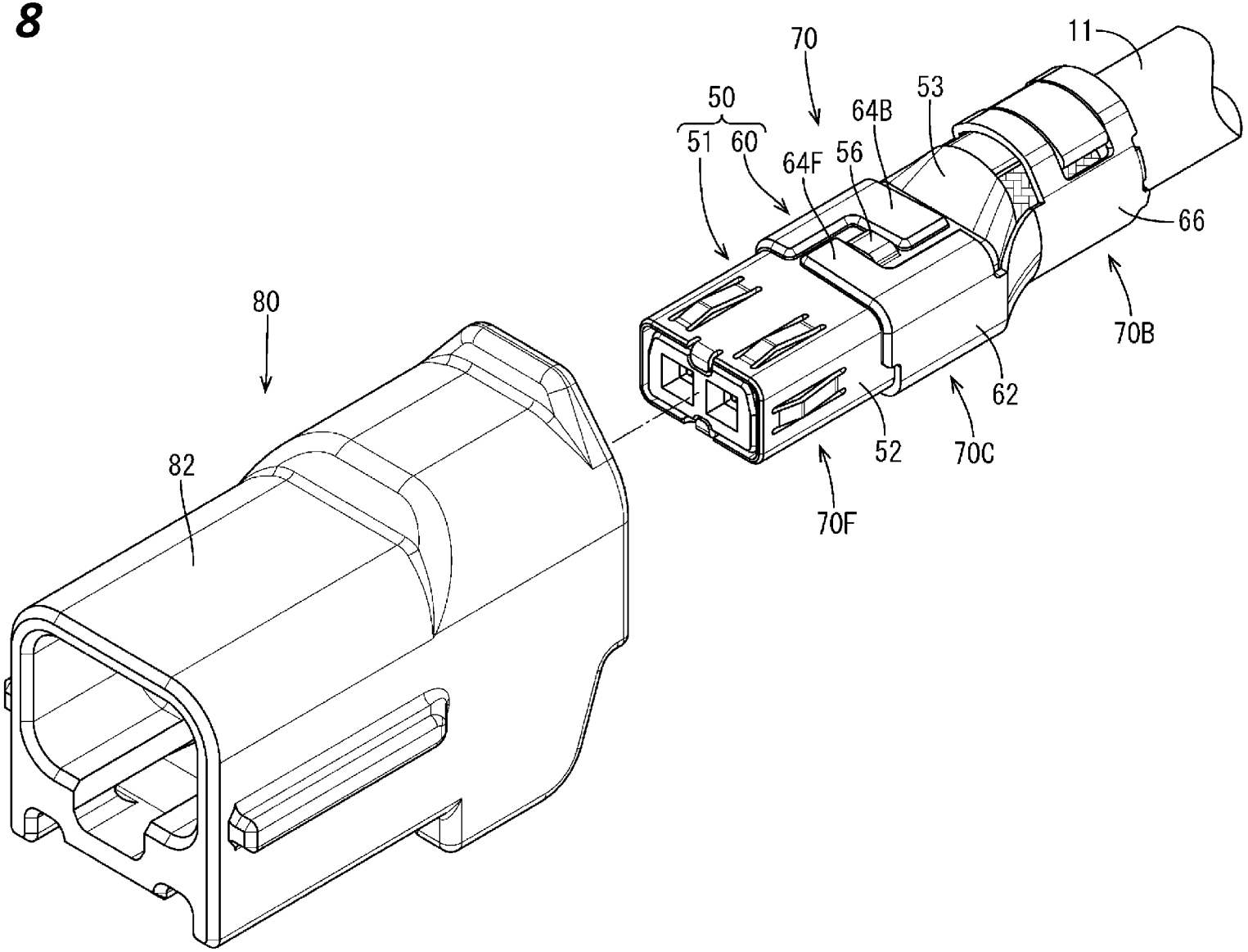
FIG. 8 is a perspective view showing a state before the terminal module is accommodated into a housing.
Figure 9:
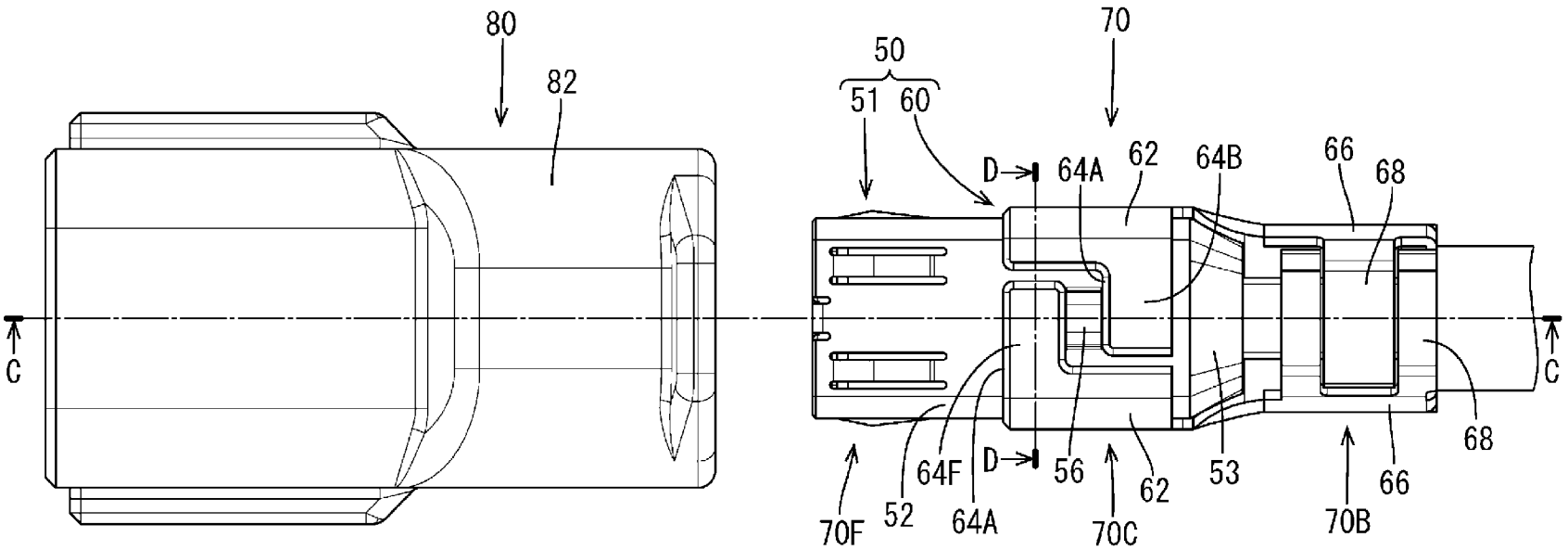
FIG. 9 is a plan view showing the state before the terminal module is accommodated into the housing.

As shown in FIGS. 8 to 10, the module accommodating portion 82 is substantially in the form of a rectangular tube penetrating in the front-back direction, and a locking lance 83 lockable to an edge part of a lance hole 61A provided in the outer conductor 50 of the terminal module 70 is provided in the module accommodating portion 82.

The locking lance 83 is fit into the lance hole 61A as shown in FIG. 3 if the terminal module 70 is accommodated at a proper accommodation position of the module accommodating portion 82, and the terminal module 70 is held in the housing 80 by the locking of the locking lance 83 and the edge part of the lance hole 61A.

As shown in FIGS. 3 and 10, the module accommodating portion 82 of the housing 80 includes a front accommodating portion 86 for accommodating the module front part 70F, a central accommodating portion 90 for accommodating the module central part 70C and a back accommodating portion 95 for accommodating the module back part 70B, and the central accommodating portion 90 has a central ceiling wall 92 capable of pressing the fixing barrels 62 in the module central part 70C toward proper crimping positions in the process of accommodating the terminal module 70 into the module accommodating portion 82.

The module accommodating portion 82 is formed with a bottom wall 84 on which the terminal module 70 is to be arranged and which extends in the front-back direction from the front end of the central accommodating portion 90 to the back end of the back accommodating portion 95.

As shown in FIG. 5, a recessed groove portion 85 in which the locking lance 83 is arranged is formed to extend in the front-back direction in a laterally central part of the bottom wall 84. Accordingly, if the terminal module 70 is accommodated into the module accommodating portion 82, the covering portion 61 of the second outer conductor 60 located opposite to the pair of fixing barrels 62 is arranged on the bottom wall 84 arranged on both sides of the groove portion 85 in the module central part 70C.

Further, as shown in FIG. 3, the central accommodating portion 90 is formed to have a smaller vertical dimension than the back accommodating portion 95, and the central ceiling wall 92 vertically facing the bottom wall 84 in the central accommodating portion 90 is lower than a back ceiling wall 97 facing the bottom wall 84 in the back accommodating portion 95.

A distance L1 between the bottom wall 84 and the central ceiling wall 92 of the central accommodating portion 90 is substantially equal to a vertical height L2 of the module central part 80 in the terminal module 70 as shown in FIG. 3. Here, substantially equal means a case where the distance L1 between the bottom wall 84 and the central ceiling wall 92 and the vertical height L2 of the module central part 70C are equal and cases where the distance L1 between the bottom wall 84 and the central ceiling wall 92 and the vertical height L2 of the module central part 70C can be regarded as substantially equal even if these are different.

Accordingly, with the terminal module 70 accommodated at the proper accommodation position in the module accommodating portion 82, the module central part 70C is fit and accommodated in the central accommodating portion 90, the bottom wall 84 of the central accommodating portion 90 and the covering portion 61 of the module central part 70C are vertically in contact, and the central ceiling wall 92 of the central accommodating portion 90 and the positioning pieces 64 of the pair of fixing barrels 62 of the module central part 70C are vertically in contact as shown in FIG. 3.

Further, a back end part of the central ceiling wall 92 of the central accommodating portion 90 on the side of the back accommodating portion 95 serves as a guiding portion 94 expanded in diameter to be rounded upward toward a back side. In other words, the guiding portion 94 is formed from the central ceiling wall 92 to the back ceiling wall 97.

On the other hand, as shown in FIGS. 6 and 7, an inclined surface 64A inclined downwardly, i.e. toward the tubular portion side, toward a front side is formed on a front edge part of the positioning piece 64 in each fixing barrel 62 of the module central part 70C on a side to be accommodated into the module accommodating portion 82.

Figure 12:
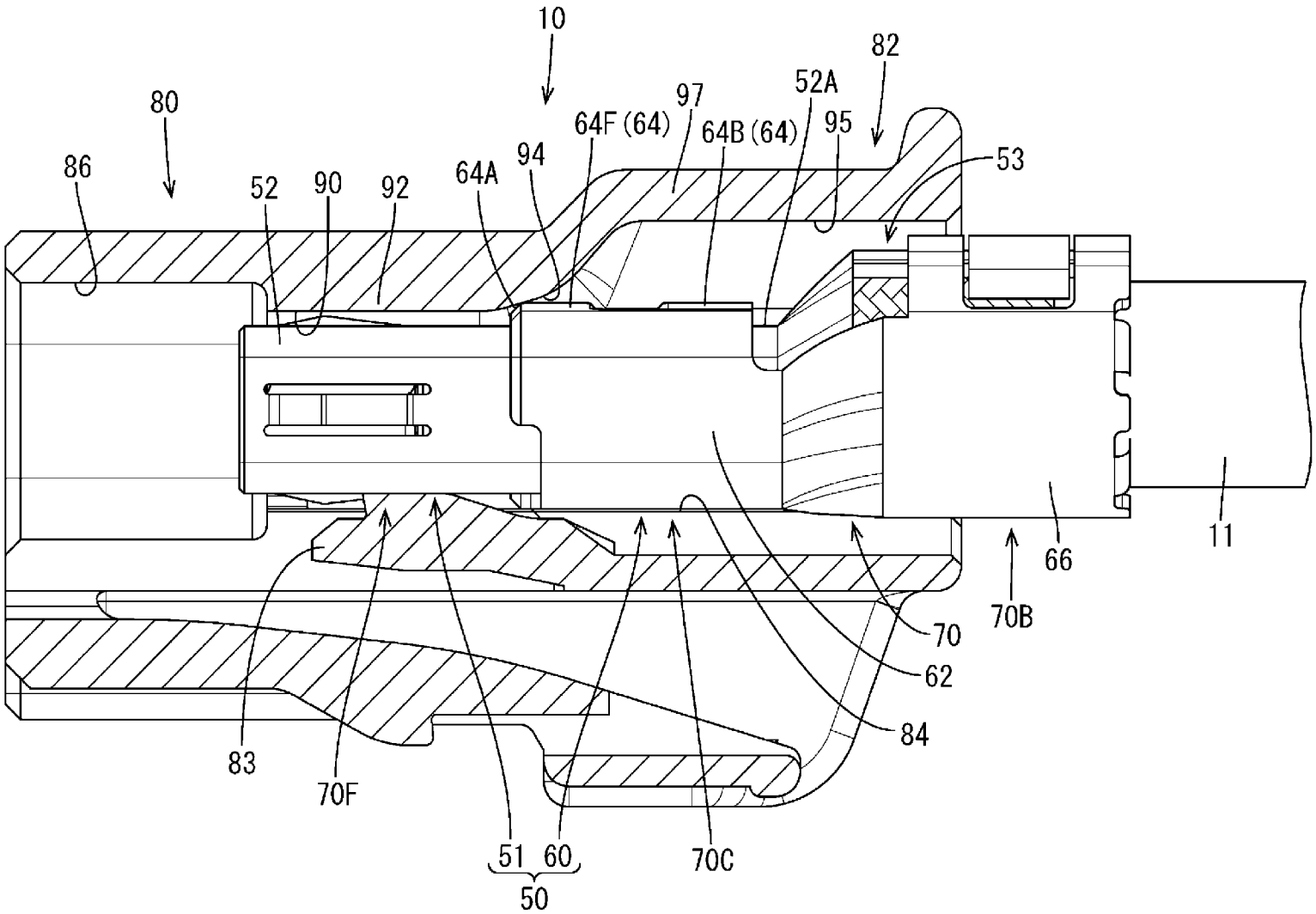
FIG. 12 is a section, corresponding to a cross-section of FIG. 3, showing a state where a module central part is slightly accommodated in a central accommodating portion in the process of accommodating the terminal module.

Accordingly, in accommodating the terminal module 70 into the module accommodating portion 82, the guiding portion 94 guides the tubular portion 52 and the positioning pieces 64 of the fixing barrels 62 crimped to the upper surface 52A of the tubular portion 52 into the central accommodating portion 90 and the inclined surfaces 64A of the positioning pieces 64 in the respective fixing barrels 62 are smoothly accommodated into the central accommodating portion 90 along the guiding portion 94 as shown in FIG. 12.

Figure 15:
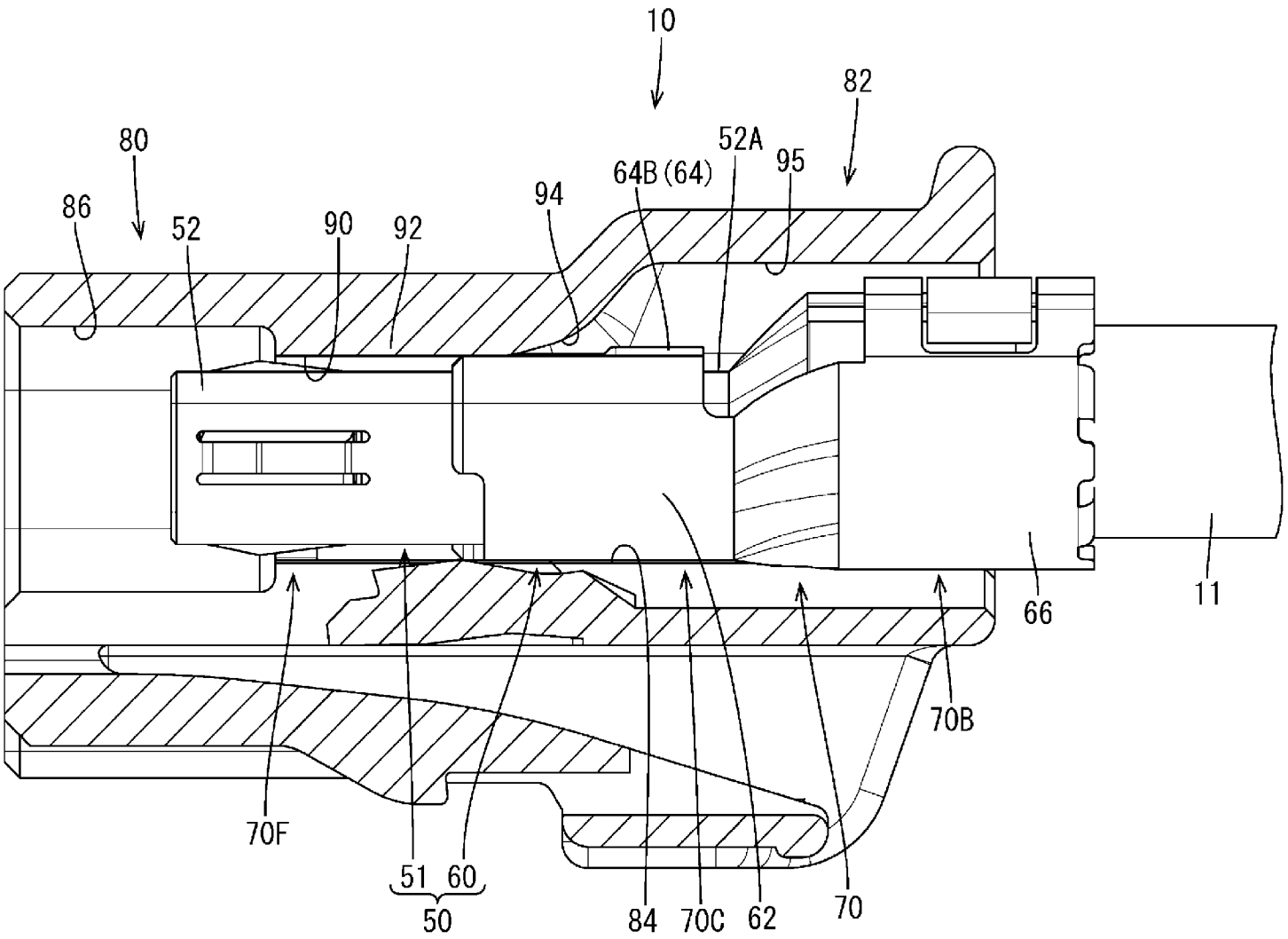
FIG. 15 is a section, corresponding to the cross-section of FIG. 3, showing a state where the module central part is shallowly accommodated in the central accommodating portion in the process of accommodating the terminal module.

Further, if the positioning pieces 64 of the fixing barrels 62 are arranged at improper crimping positions lifted from the upper surface 52A of the tubular portion 52, the positioning pieces 64 are guided into the central accommodating portion 90 by the guiding portion 94 and, as shown in FIGS. 12 and 15, the module central part 70C is vertically sandwiched by the bottom wall 84 and the central ceiling wall 92 of the central accommodating portion 90, whereby the positioning pieces 64 are pressed toward the proper crimping positions by the central ceiling wall 92.

This embodiment is configured as described above. Next, an example of an assembling procedure of the connector 10 for communication is briefly described and functions and effects of the connector 10 are described.

First, the inner conductors 20 connected to the ends of the two coated wires 12 of the shielded cable 11 are respectively accommodated into the inner conductor accommodating member 30 and, as shown in FIG. 6, the inner conductor accommodating member 30 is accommodated into the tubular portion 52 of the first outer conductor 51 from behind.

Subsequently, the second outer conductor 60 is assembled with the first outer conductor 51. As shown in FIG. 6, the second outer conductor 60 is assembled by placing the first outer conductor 51 and the folded portion 15A of the shielded cable 11 on the covering portion 61 of the second outer conductor 60 and crimping the fixing barrels 62 to wind around the back part of the tubular portion 52 and crimping the respective fixing pieces 68 of the pair of connection barrels 66 to wind around the tongue piece 55 and the shield portion 15.

Here, if the respective fixing pieces 68 are crimped to the tongue piece 55 and the shield portion 15, the hook portions 69 of the fixing pieces 68 are hooked to the side edges of the tongue piece 55 as shown in FIG. 7, whereby the fixing pieces 68 are fixed so as not to be detached from the tongue piece 55 and the shield portion 15.

On the other hand, as shown in FIGS. 7 and 11, the front side plates 63 of the pair of fixing barrels 62 are arranged along the side surfaces 52W of the tubular portion 52, the front positioning piece 64F is arranged in front of the positioning protrusion 56 on the upper surface 52A of the tubular portion 52 and the back positioning piece 64B is arranged behind the positioning protrusion 56 on the upper surface 52A of the tubular portion 52. In this way, the terminal module 70 is completed.

The connection barrels 66 in the second outer conductor 60 are fixed not to be detached from the shield portion 15 by the hook portions 69 of the fixing pieces 68 being hooked to the side edges of the tongue piece 55.

Figure 13:
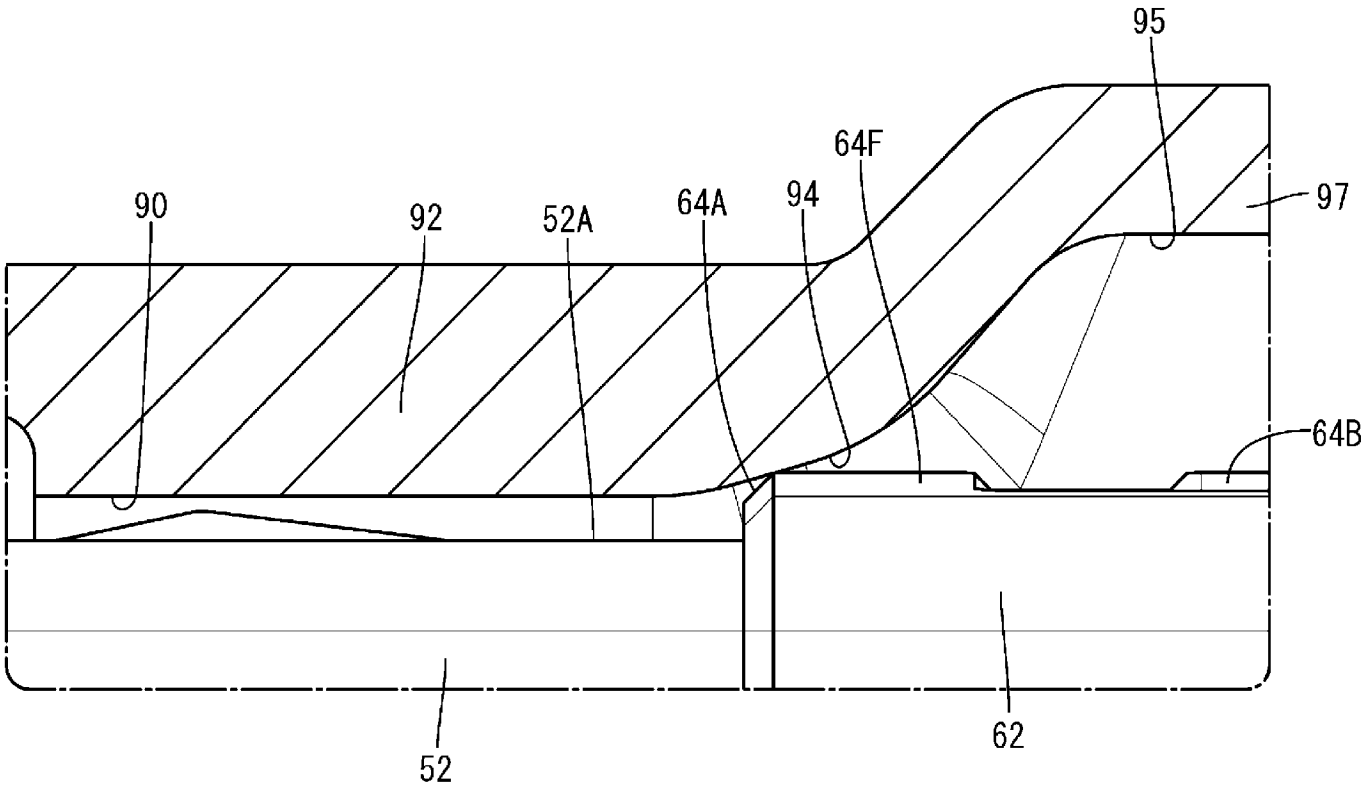
FIG. 13 is an enlarged section showing an essential part of FIG. 12.
Figure 14:
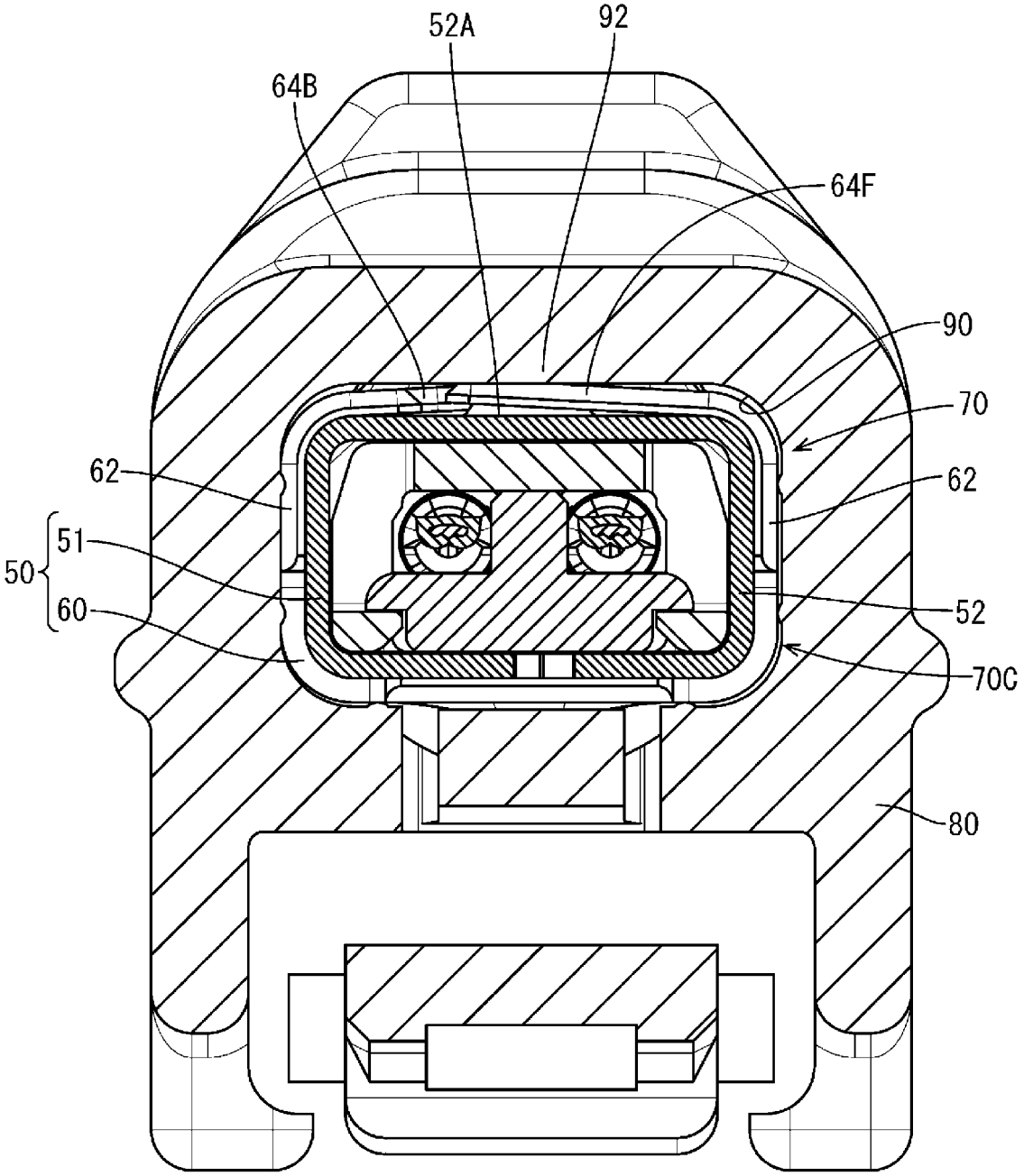
FIG. 14 is a circumferential section showing the state where the module central part is slightly accommodated in the central accommodating portion in the process of accommodating the terminal module.

However, since the positioning pieces 64 of the fixing barrels 62 are not configured to be hooked to the tubular portion 52, there is a concern that the positioning pieces 64 are lifted from the upper surface 52A of the tubular portion 52 as shown in FIGS. 11 to 13, due to so-called springback to slightly return to an initial state if the fixing barrels 62 are crimped to the upper surface 52A of the tubular portion 52.

However, the back end part of the central ceiling wall 92 in the central accommodating portion 90 of the module accommodating portion 82 of this embodiment serves as the guiding portion 94 expanded in diameter to be rounded upward toward the back side as shown in FIGS. 10, 12 and 15, and the distance L1 between the bottom wall 84 and the central ceiling wall 92 of the central accommodating portion 90 is substantially equal to the vertical height L2 of the module central part 70C in the terminal module 70.

Accordingly, if the positioning pieces 64 of the fixing barrels 62 are arranged at improper crimping positions lifted from the upper surface 52A of the tubular portion 52, the positioning pieces 64 are guided into the central accommodating portion 90 by the guiding portion 94 when the terminal module 70 is inserted into the module accommodating portion 82 from behind to complete the connector 10 for communication.

Figure 16:
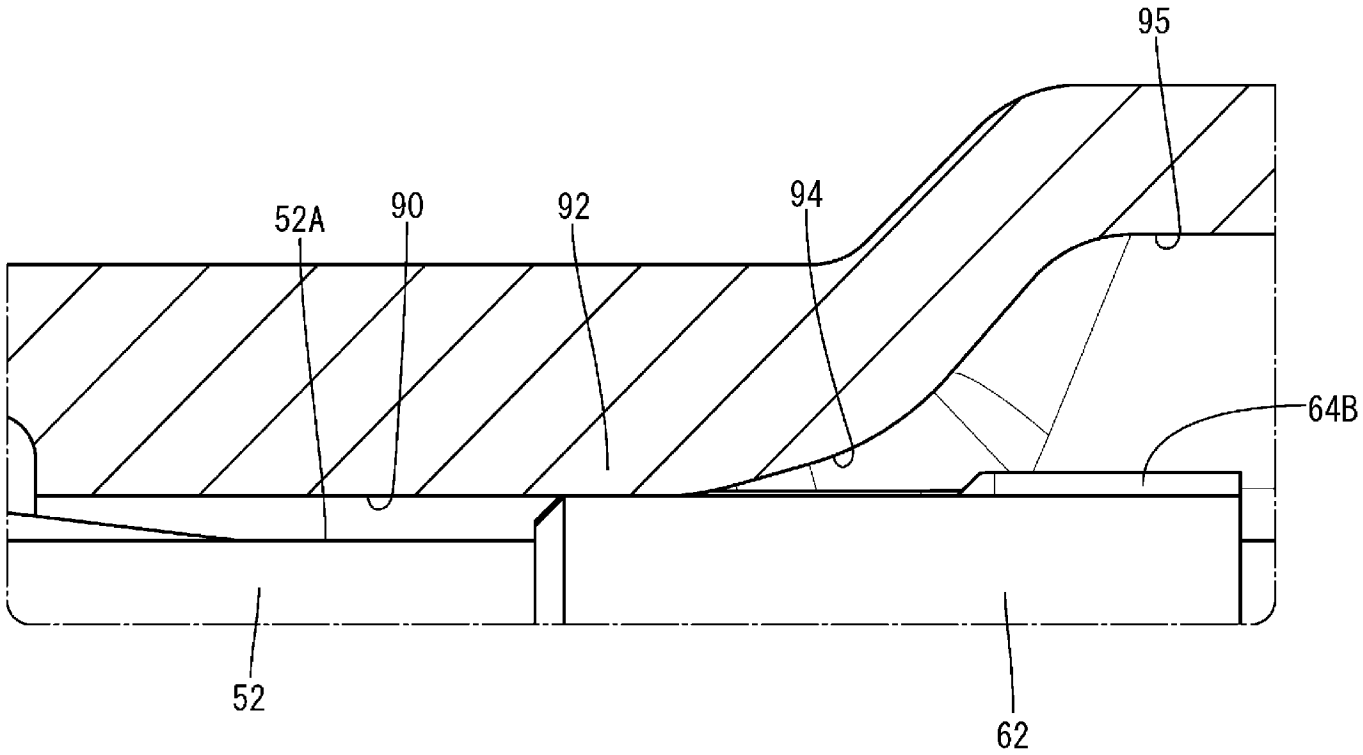
FIG. 16 is an enlarged section showing an essential part of FIG. 15.

In particular, if the terminal module 70 is accommodated into the module accommodating portion 82 from behind, the front positioning piece 64F in the module central part 70C first contacts the guiding portion 94 from behind as shown in FIGS. 12 and 13. If the terminal module 70 is further pushed into the module accommodating portion 82, the front positioning piece 64F is pressed toward the proper crimping position by the central ceiling wall 92 of the central accommodating portion 90 as shown in FIGS. 15 and 16.

Figure 4:
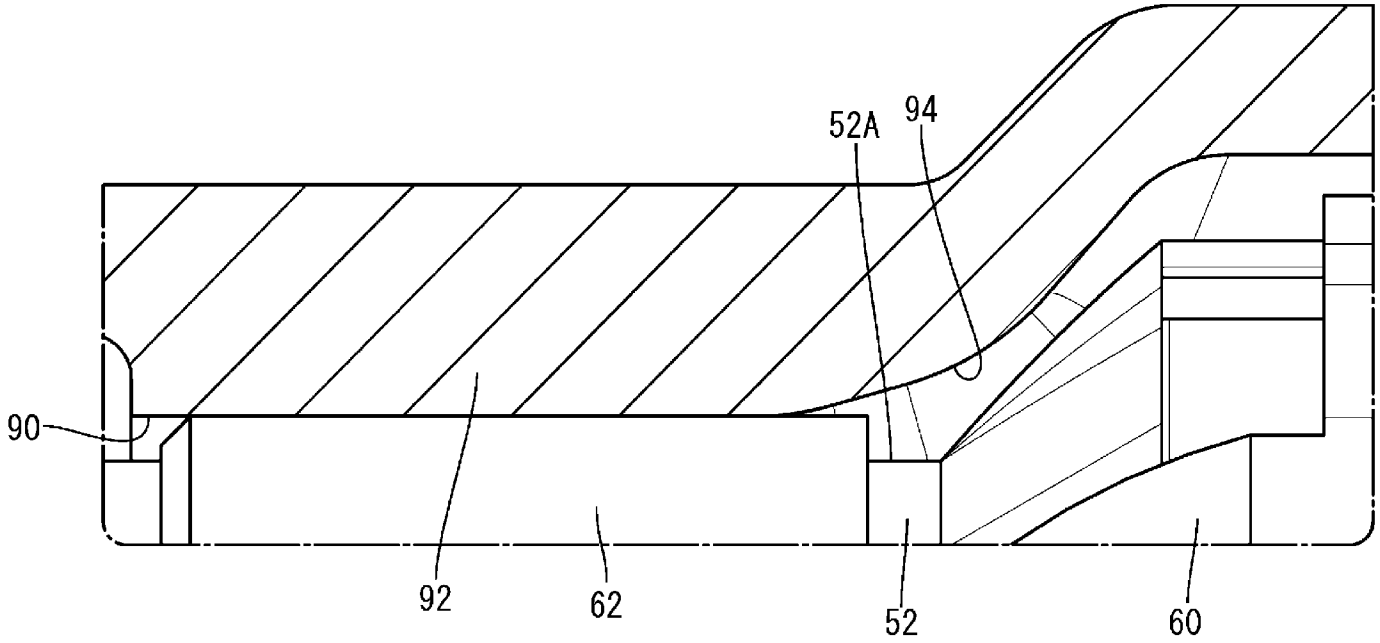
FIG. 4 is an enlarged section showing an essential part of FIG. 3.

Thereafter, if the terminal module 70 is further pushed into the module accommodating portion 82, the module central part 70C is vertically sandwiched by the bottom wall 84 and the central ceiling wall 92 of the central accommodating portion 90 and the back positioning piece 64B is pressed toward the proper crimping position by the central ceiling wall 92 as shown in FIGS. 3 to 5. In this way, a springback state of the two positioning pieces 64 of the fixing barrels 62 can be prevented.

That is, it is possible to suppress the occurrence of troubles such as a reduction in communication quality in the terminal module 70 caused by the positioning pieces 64 arranged at lifted improper crimping positions.

Further, if the positioning pieces 64 are arranged at the improper crimping positions lifted from the upper surface 52A of the tubular portion 52, there is a concern that the positioning piece 64 and the positioning protrusion 56 cannot be locked in the front-back direction.

However, since the positioning pieces 64 are arranged at the proper crimping positions, the detachment of the outer conductor 50 from the shielded cable 11 can be prevented by the locking of the positioning piece 64 and the positioning protrusion 56 in the front-back direction, for example, when the shielded cable 11 is pulled.

Figure 17:
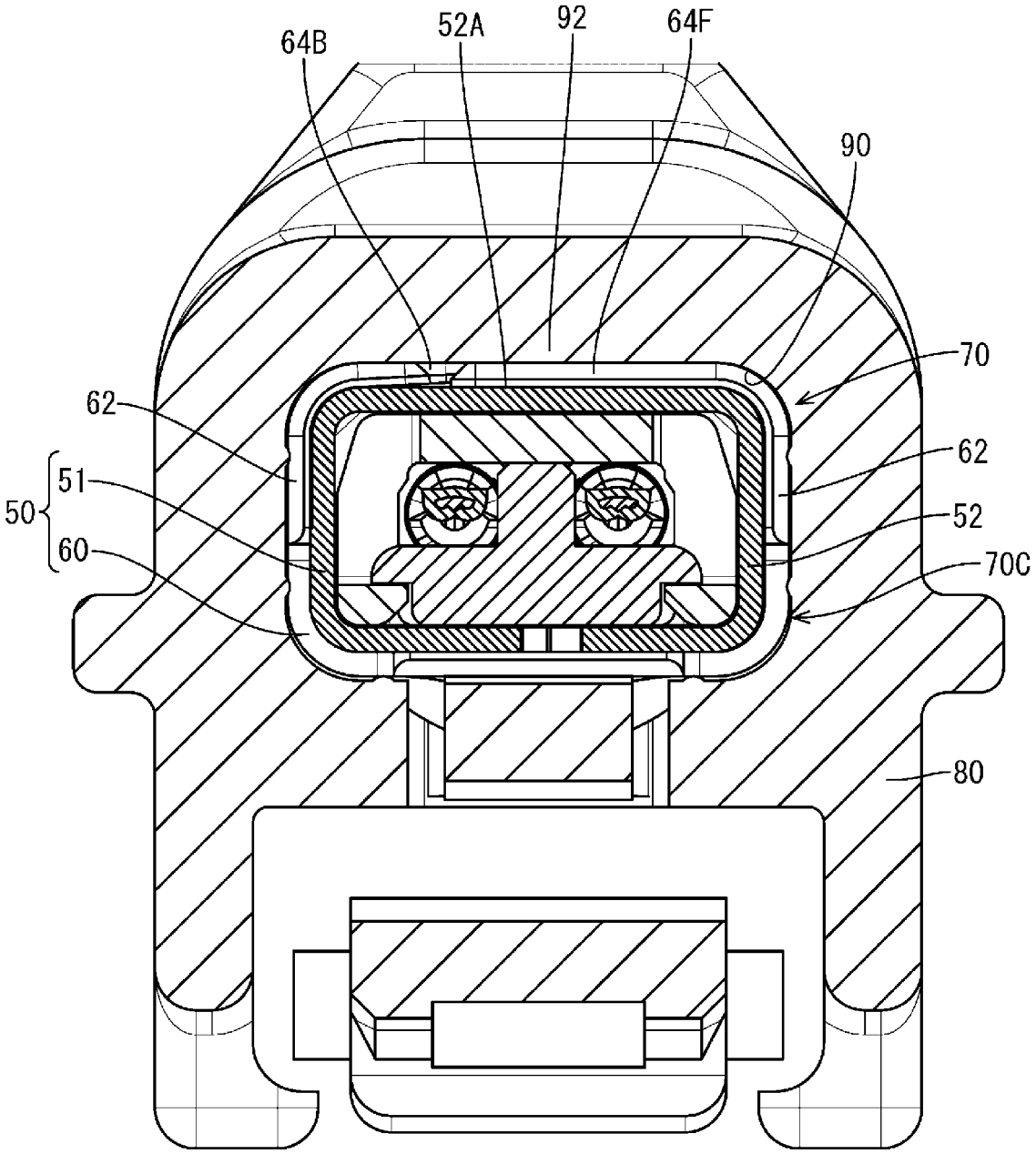
FIG. 17 is a circumferential section showing the state where the module central part is shallowly accommodated in the central accommodating portion in the process of accommodating the terminal module.

As described above, the connector 10 of this embodiment is provided with the shielded cable 11 including the conductive shield portion 15 for covering the outer periphery of at least one coated wire 12 and the sheath portion 16 for covering the outer periphery of the shield portion 15, the first outer conductor 51 including the tubular portion (connecting portion) 52 and to be connected to the shield portion 15, the second outer conductor 60 including at least one plate-like fixing barrel 62 to be crimped to wind around the outer surface of the tubular portion 52 in the circumferential direction, and the housing 80 including the module accommodating portion (terminal accommodating portion) 82 for accommodating the outer conductor 50 formed by the first and second outer conductors 51, 60 by the fixing barrels 62 being crimped to the tubular portion 52, and the module accommodating portion 82 includes the central ceiling wall 92 (pressing portion) capable of pressing the fixing barrels 62 toward the proper crimping positions in the process of accommodating the outer conductor 50 as shown in FIGS. 15 and 17.

That is, according to the connector of this embodiment, if the fixing barrels 62 are arranged at improper crimping positions lifted from the outer surface of the tubular portion 52 and different from the proper crimping positions, the fixing barrels 62 can be arranged at the proper crimping positions by being pressed by the central ceiling wall 92 in accommodating the outer conductor 50 into the module accommodating portion 82.

In this way, the springback state of the fixing barrels 62 of the outer conductor 50 can be prevented and the occurrence of troubles such as a reduction in communication quality in the connector 10 can be prevented.

Further, since the fixing barrels 62 are pressed by the central ceiling wall 92, it is not necessary to separately form a pressing portion for pressing the fixing barrels 62 in the module accommodating portion 82. Thus, the complication of the structure of the module accommodating portion 82 can be prevented.

Further, the module accommodating portion 82 includes the bottom wall 84 on which the covering portion (bottom part) 61 located opposite to the fixing barrels 62 in the outer conductor 50 is to be arranged, and the distance L1 between the bottom wall 84 and the central ceiling wall 92 is substantially equal to the height L2 of a part crimped with the fixing barrels 62 in the outer conductor 50. Thus, in accommodating the outer conductor 50 into the module accommodating portion 82, the fixing barrels 62 are pressed by the central ceiling wall 92 so that the outer conductor 50 is sandwiched by the bottom wall 84 and the central ceiling wall 92. In this way, the fixing barrels 62 can be arranged at the proper crimping positions.

The second outer conductor 60 further includes at least one connection barrel 66 to be crimped to the shield portion 15 together with the first outer conductor 51, the module accommodating portion 82 includes the central accommodating portion (first accommodating portion) 90 for accommodating the fixing barrels 62 and the back accommodating portion (second accommodating portion) 95 for accommodating the connection barrels 66, and the central ceiling wall 92 is formed from the back end part of the central accommodating portion 90 on the side of the back accommodating portion 95 to a front end part of the central accommodating portion 90.

For example, if a pressing portion capable of pressing fixing barrels is provided on an end part of a module accommodating portion, there is a concern that the pressing portion is damaged due to the contact of the pressing portion with another member during the conveyance of a housing and the fixing barrels cannot be arranged at proper crimping positions or an outer conductor cannot be accommodated into a terminal accommodating portion due to the collision of the damaged pressing portion and the outer conductor.

However, according to this configuration, since the central ceiling wall 92 is formed from the back end of the central accommodating portion 90 toward the front end of the central accommodating portion 90, the contact of another member with the central ceiling wall 92 can be prevented.

Further, since the back end part of the central ceiling wall 92 on the side of the back accommodating portion 95 is expanded in diameter to be rounded upward from the first accommodating portion side toward the second accommodating portion side as shown in FIGS. 10, 13, 15 and 16, the fixing barrels 62 can be guided into the central accommodating portion 90 by the central ceiling wall 92 and the outer conductor 50 can be accommodated into the module accommodating portion 82. In this way, an operation of accommodating the outer conductor 50 can be smoothly performed.

Further, the tubular portion 52 is formed with the positioning protrusion 56 projecting upward (outward), the second outer conductor 60 includes the pair of fixing barrels 62 and the pair of fixing barrels 62 are crimped to both sides of the positioning protrusion 56 in the front-back direction, which is the extending direction of the shielded cable 11.

That is, since the pair of fixing barrels 62 are reliably arranged at the proper crimping positions by the central ceiling wall 92, the detachment of the outer conductor 50 from the shielded cable 11 can be reliably prevented by the locking of the fixing barrel 62 and the positioning protrusion 56 in the front-back direction.

Further, since the inclined surfaces 64A inclined toward the tubular portion 52 along the forward direction in which the outer conductor 50 is accommodated are formed on the front end edge parts of the fixing barrels 62 on the side to be accommodated into the module accommodating portion 82, it can be suppressed that the central ceiling wall 92 and the guiding portion 94 are scraped to be damaged by the fixing barrels 62, for example, as compared to the case where edges are provided on the end edge parts of the fixing barrels.

Other Embodiments

The technique disclosed in this specification is not limited to the above described and illustrated embodiment and includes, for example, the following various modes.

(1) In the above embodiment, the positioning pieces 64 are pressed by the central ceiling wall 92 of the central accommodating portion 90. However, without limitation to this, a pressing portion for pressing positioning pieces before the positioning pieces are accommodated may be formed in a central accommodating portion.

(2) In the above embodiment, the shielded cable 11 includes two coated wires 12 and the inner conductor accommodating member 30 accommodates two inner conductors 20. However, without limitation to this, a shielded cable may include three or more coated wires and a terminal accommodating member may accommodate three or more inner conductors.

(3) In the above embodiment, the inner conductor 20 is configured as a male terminal. However, without limitation to this, an inner conductor may be configured as a female terminal.

(4) In the above embodiment, the guiding portion 94 is expanded in diameter to be rounded. However, without limitation to this, a guiding portion may be flatly expanded in diameter.

LIST OF REFERENCE NUMERALS

10: connector
11: shielded cable
12: coated wire
15: shield portion
16: sheath portion
50: outer conductor
51: first outer conductor
52: tubular portion (example of "connecting portion")
60: second outer conductor
61: covering portion (example of "bottom part")
62: fixing barrel
64: positioning piece (example of "fixing barrel")
64A: inclined surface
66: connection barrel
80: housing
82: module accommodating portion (example of "terminal accommodating portion")
84: bottom wall
90: central accommodating portion (example of "first accommodating portion")
92: central ceiling wall (example of "pressing portion", "ceiling wall")
95: back accommodating portion (example of "second accommodating portion")
L1: distance between bottom wall and pressing portion
L2: height of part crimped with fixing barrels

What is claimed is:

1. A connector, comprising:

a shielded cable including a conductive shield portion for covering an outer periphery of at least one coated wire and a sheath portion for covering an outer periphery of the shield portion;

a first outer conductor connected to the shield portion and including a tubular connecting portion;

a second outer conductor including at least one plate-like fixing barrel configured to be crimped to wind around an outer surface of the connecting portion in a circumferential direction and at least one connection barrel configured to be crimped to the shield portion together with the first outer conductor; and a housing including a terminal accommodating portion for accommodating an outer conductor formed by the first and second outer conductors by the fixing barrel being crimped to the connecting portion, wherein the terminal accommodating portion includes a first accommodating portion for accommodating the fixing barrel, a second accommodating portion for accommodating the connection barrel, and a pressing portion configured to press the fixing barrel toward a proper crimping position in the process of accommodating the outer conductor, and wherein the pressing portion is formed from an end part of the first accommodating portion on a second accommodating portion side toward an end part of the first accommodating portion opposite to the second accommodating portion.

2. The connector of claim 1, wherein:

the terminal accommodating portion includes a bottom wall, a bottom part of the outer conductor being located opposite to the fixing barrel and being arranged on the bottom wall, and a distance between the bottom wall and the pressing portion is substantially equal to a height of a part crimped with the fixing barrel in the outer conductor.

3. The connector of claim 1, wherein an end part of the pressing portion on the second accommodating portion side is expanded in diameter to be rounded from a first accommodating portion side toward the second accommodating portion side.

4. The connector of claim 1, wherein the pressing portion is a ceiling wall facing the bottom wall in the first accommodating portion.

5. The connector of claim 1, wherein:

the connecting portion is formed with a protrusion projecting outward, the second outer conductor includes a pair of the fixing barrels, and the pair of fixing barrels are crimped to both sides of the protrusion in an extending direction of the shielded cable.

6. The connector of claim 1, wherein an inclined surface inclined toward a connecting portion side along an accommodation direction of the outer conductor is formed on an end edge part of the fixing barrel on a side to be accommodated into the terminal accommodating portion.

* * * * *